US011096426B2

(12) United States Patent
Sheppard

(10) Patent No.: US 11,096,426 B2
(45) Date of Patent: Aug. 24, 2021

(54) INFANT TEETHING BODYSUIT

(71) Applicant: Daniel Ryan Sheppard, Lacey, WA (US)

(72) Inventor: Daniel Ryan Sheppard, Lacey, WA (US)

( * ) Notice: Subject to any disclaimer, the term of this patent is extended or adjusted under 35 U.S.C. 154(b) by 0 days.

(21) Appl. No.: 16/447,625

(22) Filed: Jun. 20, 2019

(65) Prior Publication Data

US 2020/0397066 A1 Dec. 24, 2020

(51) Int. Cl.

*A41D 11/00* (2006.01)
*A41B 13/00* (2006.01)
*A61J 17/02* (2006.01)

(52) U.S. Cl.

CPC ..... *A41B 13/005* (2013.01); *A41D 11/00* (2013.01); *A61J 17/02* (2013.01); *A41B 2400/32* (2013.01); *A41B 2400/62* (2013.01); *A41B 2500/50* (2013.01)

(58) Field of Classification Search

CPC ..... A41B 13/005; A41B 2500/50; A41B 2400/32; A41B 2400/62; A41D 11/00; A61J 17/02
USPC ..... 2/80
See application file for complete search history.

(56) References Cited

U.S. PATENT DOCUMENTS 6,047,404 A 4/2000 Blanks
10,104,916 B2 * 10/2018 Barski ..... A61J 17/111
10,172,767 B2 1/2019 Hyslop
2005/0222621 A1 10/2005 Duwelius et al.
2006/0004412 A1 1/2006 Gilbert
2006/0041275 A1 * 2/2006 Powers ..... A61J 17/02 606/215
2013/0247277 A1 * 9/2013 Turbovich ..... A41D 27/00 2/243.1
2014/0250558 A1 * 9/2014 Russo ..... A41B 13/10 2/49.4
2015/0059050 A1 * 3/2015 Cousin ..... A41B 13/08 2/80
2017/0156989 A1 6/2017 Hunter
2018/0071173 A1 * 3/2018 Hunter ..... A41B 13/005
2018/0263858 A1 9/2018 Williams
2018/0310648 A1 11/2018 Rhodes

* cited by examiner

*Primary Examiner* — Katherine M Moran
(74) *Attorney, Agent, or Firm* — UCLA Patent Law Clinic

(57) ABSTRACT

Articles for Infant teething bodysuit in accordance with embodiments of the invention are disclosed. In one embodiment, an article of clothing comprising: a first arm portion comprising: a first teething surface wherein the first teething surface is affixed to a distal end of the first arm portion, and the first teething surface curves perpendicular to the length of the first arm portion; and a first water resistant surface attached to an outer surface of the distal end of the first arm portion; and a second arm portion comprising: a second teething surface wherein the second teething surface is affixed to a distal end of the second arm portion; and the second teething surface curves perpendicular to the length of the second arm portion; and a second water resistant surface attached to an outer surface of the distal end of the second arm portion.

18 Claims, 7 Drawing Sheets

200

300

350

400

INFANT TEETHING BODYSUIT

FIELD OF THE INVENTION

The present invention generally relates to clothing and mores specifically to clothing for infants incorporating teething products.

BACKGROUND

As early as two months old, infants begin to grow their first set of teeth and start exhibiting teething behavior. As the teeth break the gum surface, infants can experience immense gum and jaw discomfort and inflammation of the mouth. Other symptoms can include increased drooling, irritability, loss of appetite, fussiness, and difficulty sleeping. The growing in of the large molars can be particularly painful as the large molars have a wider, flatter surface area, as compared to other teeth, and thus are unable to slice through the gum surface, causing more irritation in the back of the mouth.

SUMMARY OF THE INVENTION

The various embodiments of the present articles of infant clothes with one or more teething surfaces contain several features, no single one of which is solely responsible for their desirable attributes. Without limiting the scope of the present embodiments, their more prominent features will now be discussed below. In particular, the present articles of infant clothes with teething surfaces will be discussed in the context of infant teething bodysuits (may also be referred to as "infant bodysuits" or "bodysuits"). However, the use of infant teething bodysuits are merely exemplary and various other articles of infant clothes with teething surfaces may be utilized for soothing a teething child as appropriate to the requirements of a specific application in accordance with various embodiments of the invention. After considering this discussion, and particularly after reading the section entitled "Detailed Description," one will understand how the features of the present embodiments provide the advantages described here.

One aspect of the present embodiments includes the realization that most teething children naturally put objects in their mouth in an attempt to relieve pressure on the gums and soothe the pain. When no objects are in reach, children will often bite their hands. The constant moisture and biting of the hands can cause redness, tenderness, chaffing, and even bleeding. Presently, various teething devices are manufactured and sold as small, individual items. The most common item is the teething ring, a soft plastic with rounded edges that a child is able to hold and is not easily swallowed. However, because the child typically holds teething product, the item will often be dropped on the floor, become dirty, or be lost. Because of an infant's lack of fine motor skills, the infant has a trouble of locating and re-grasping the device. Further, because of a child's inability to hold the teething product, this may require additional attention from the parent to prevent the child from teething on its own hands or putting undesired objects in their mouth. Additionally, the costs of replacing these items when they are lost or misplaced can compound the financial burden for the parents. Thus, one aspect of the present embodiments includes the realization that there is a need for an apparatus that integrates infant clothing with a teething item attached thereto. The present embodiment solve the above problems by affixing the teething device to the child's clothing, such that the teething device (may also be referred to as "teething surface") will always be readily accessible to the child and will not be removable or easily tossed aside by the child.

Another aspect of the present embodiments includes the realization that teething children are unable to use teething products to reach the back molars of their mouth. For example, many teething products have large and rounded surface area, such that the teething material can only be utilized by the front teeth, getting stuck because of the limited size of the child's mouth. The present embodiments solve this problem by using a hook like teething piece to allow for teething in the back of the mouth. The present embodiments provide these advantages and enhancements, as described below.

In a first aspect, an article for Infant teething bodysuit in accordance with embodiments of the invention is disclosed. In one embodiment, an article of clothing for soothing a teething child comprising: a first arm portion comprising: a first teething surface wherein the first teething surface is affixed to a distal end of the first arm portion, and the first teething surface curves perpendicular to the length of the first arm portion; and a first water resistant surface attached to an outer surface of the distal end of the first arm portion; and a second arm portion comprising: a second teething surface wherein the second teething surface is affixed to a distal end of the second arm portion, and the second teething surface curves perpendicular to the length of the second arm portion; and a second water resistant surface attached to an outer surface of the distal end of the second arm portion.

In an embodiment of the first aspect, the article of clothing further comprising a neck portion comprising a front inner surface, a front outer surface, a rear inner surface, and a rear outer surface.

In another embodiment of the first aspect, the article of clothing further comprising a third water resistant surface attached to the front outer surface of the neck portion.

In another embodiment of the first aspect, the article of clothing further comprising a chest portion and a bottom portion.

In another embodiment of the first aspect, the article of clothing further comprising the bottom portion further comprising a first leg portion.

In another embodiment of the first aspect, the article of clothing further comprising the first leg portion further comprising a fourth water resistant surface attached to an outer surface of a distal end of the first leg portion.

In another embodiment of the first aspect, the article of clothing further comprising the bottom portion further comprising a second leg portion.

In another embodiment of the first aspect, the article of clothing further comprising the second leg portion further comprising a fifth water resistant surface attached to an outer surface of a distal end of the second leg portion.

In another embodiment of the first aspect, the article of clothing further comprising a third teething surface wherein the third teething surface is affixed to a distal end of the first leg portion.

In another embodiment of the first aspect, the article of clothing further comprising a fourth teething surface wherein the fourth teething surface is affixed to a distal end of the second leg portion.

In another embodiment of the first aspect, the first, second, third, fourth, and fifth water resistant surfaces are made of polyvinyl chloride.

In another embodiment of the first aspect, the first, second, third, fourth, and fifth water resistant surfaces are made of polyurethane.

In another embodiment of the first aspect, the first, second, third, fourth, and fifth water resistant surfaces are made of fluoropolymers.

In another embodiment of the first aspect, the first, second, third, and fourth teething surfaces are made of silicone.

In another embodiment of the first aspect, the first, second, third, and fourth teething surfaces are made of rubber.

In another embodiment of the first aspect, the first, second, third, and fourth teething surfaces are detachable from the first arm portion, second arm portion, first leg portion, or second leg portion.

In another embodiment of the first aspect, the first arm portion and second arm portion are detachable from the article of clothing.

In another embodiment of the first aspect, a hand portion of the first arm portion and a hand portion of the second arm portion are detachable from the article of clothing.

In another embodiment of the first aspect, the article of clothing further comprises a fastening arrangement.

In another embodiment of the first aspect, the fastening arrangement is at least one of a zipper, a button, a snap, a hook, and Velcro based closure.

BRIEF DESCRIPTION OF THE DRAWINGS

The various embodiments of the present article of infant clothing with one or more teething surfaces for soothing a child now will be discussed in detail, highlighting the advantageous features. These embodiments depict the novel and non-obvious article of infant clothing shown in the accompanying drawings, which are for illustrative purposes only. These drawings include the following figures.

DETAILED DESCRIPTION OF THE DRAWINGS

Figure 1A:
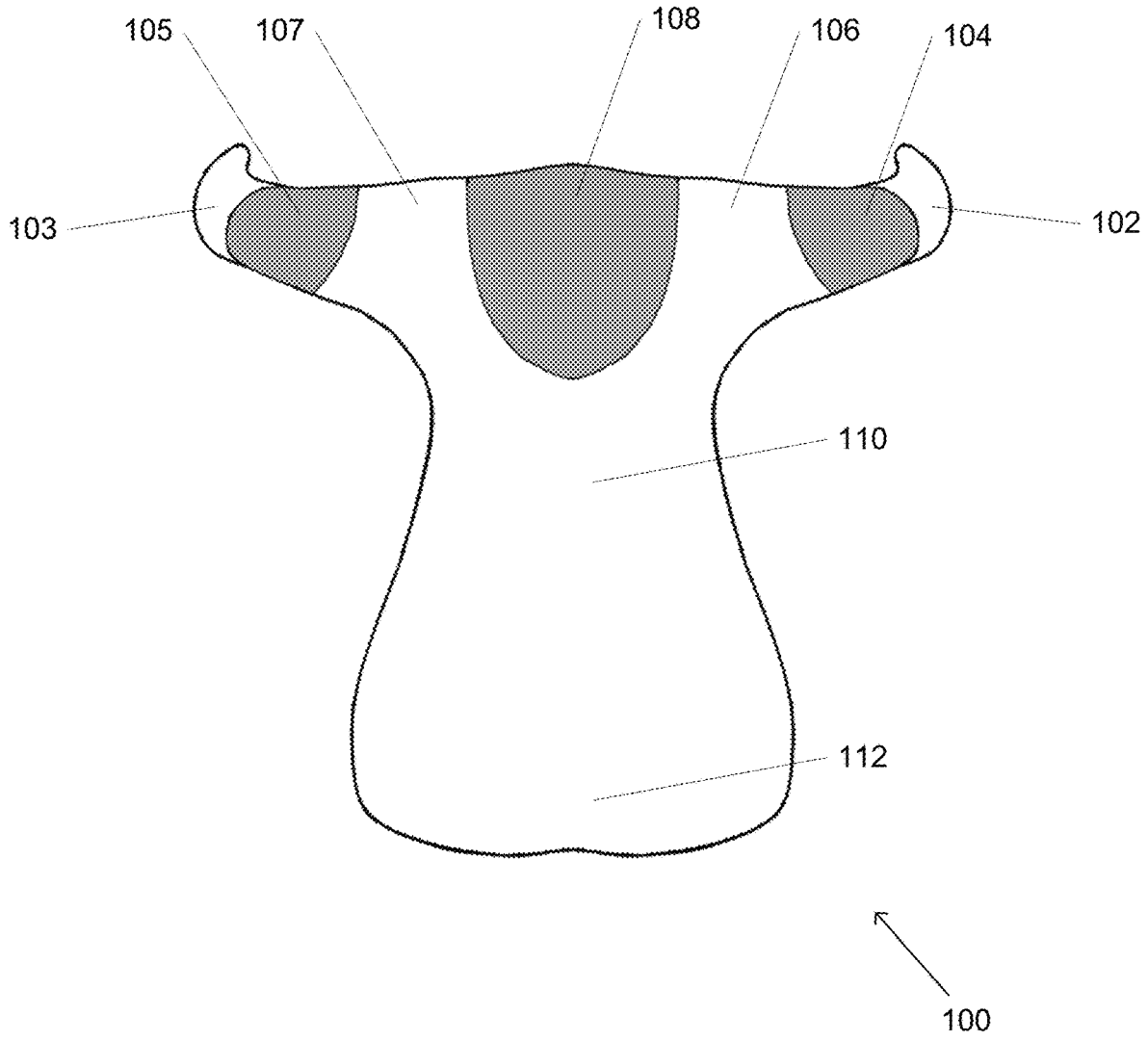
FIG. 1A illustrates a front view of an article of infant clothing with detachable teething surfaces and an enclosed bottom in accordance with an embodiment of the invention.

The following detailed description describes the present embodiments with reference to the drawings. In the drawings, reference numbers label elements of the present embodiments. These reference numbers are reproduced below in connection with the discussion of the corresponding drawing features.

Turning now to the drawings, an article of infant clothing with one or more teething surfaces for soothing a child are disclosed. In various embodiments, a child wearing the article of clothing may have reduced mobility of their limbs. In many embodiments, each of the child's limbs may be fully enclosed in the article of clothing. In some embodiments the article of clothing may have a zipper enclosure. In several embodiments, these articles of clothing may be partially made from water resistant fabrics, such that a child's saliva will not be absorbed by the underlying fabric and make the child's skin irritated. In some embodiments, a flexible silicone may be affixed to the end of the arm end, allowing the child to teethe on the silicone. In some embodiments, the teething surface may be flat and curved like a hook, allowing the child to teethe not only their front teeth but also the back teeth (i.e. molars and pre-molars). An article of infant clothing with teething surfaces for soothing a child in accordance with embodiments of the invention are further discussed below.

Bodysuit with Teething Surfaces

An infant bodysuit may be constructed to have one or more teething surfaces. For example, an infant bodysuit may be constructed of a flexible fabric such as cotton and the like. A front view of an article of infant clothing with a water resistant surface in accordance with an embodiment of the invention is shown in FIG. 1A. The infant bodysuit 100 may include teething surfaces 102, 103, distal arm portions 104, 105, proximal arm portions 106, 107, a neck portion 108, a chest portion 110, and a bottom portion 112.

In reference to FIG. 1A, the distal arm portion 104 and the proximal arm portion 106 together may form one of the sleeves of the infant bodysuit 100. The other distal arm portion 105 and the other proximal arm portion 107 together may form the other sleeve of the infant bodysuit 100. In various embodiments, the sleeves may be located on either side of the bodysuit 100. In many embodiments, the neck portion 108 may be located between the two sleeves. In a variety of embodiments, the bottom portion 112 may be an enclosed bottom part and it may cover an infant's legs and/or feet. The bottom portion 112 may also include an open bottom, allowing the infant's legs and feet to go through the bottom. In many embodiments, the chest portion 110 and bottom portion 112 may be unfitted or loose, allowing a child's legs and feet to move around within the article of clothing 100. In addition, the chest portion 110 is located between the neck portion 108 and the bottom portion 112.

In further reference to FIG. 1A, the distal arm portions 104, 105 and the neck portion 108 may be covered with water resistant surface such as, but not limited to, polyvinyl chloride or polyurethane, to prevent saliva from penetrating the underlying fabric near the infant's hands and forearms and the infant's neck and chest area, respectively. In other embodiments, the distal arm portions 104, 105 may be made using the water resistant material and not merely a covering. In such embodiments, the bodysuit 100 may be constructed with a plurality of sections with different sections of the plurality of sections made of different materials.

In addition, the teething surface 102, as an extension of an infant's arm when in the body suit 100, may be attached to the end of the distal arm portion 104. Likewise, the teething surface 103, as an extension of an infant's arm when in the body suit 100, may be attached to the end of the distal arm portion 105. The teething surfaces 102, 103 may be hook-like or curved to allow the teething surfaces to better fit into an infant's mouth. However, the shape of the teething surfaces 102, 103 may vary. For example, in another embodiment, the teething surfaces 102, 103 may be a triangular or rectangular extension with a semicircle protrusion. The teething surfaces 102, 103 may be attached to the bodysuit 100 such that a curved extension of the teething surfaces 102, 103 angle up towards where a child's mouth would be. In some embodiments, the teething surfaces 102, 103 may be detachable from the bodysuit 100.

Figure 1B:
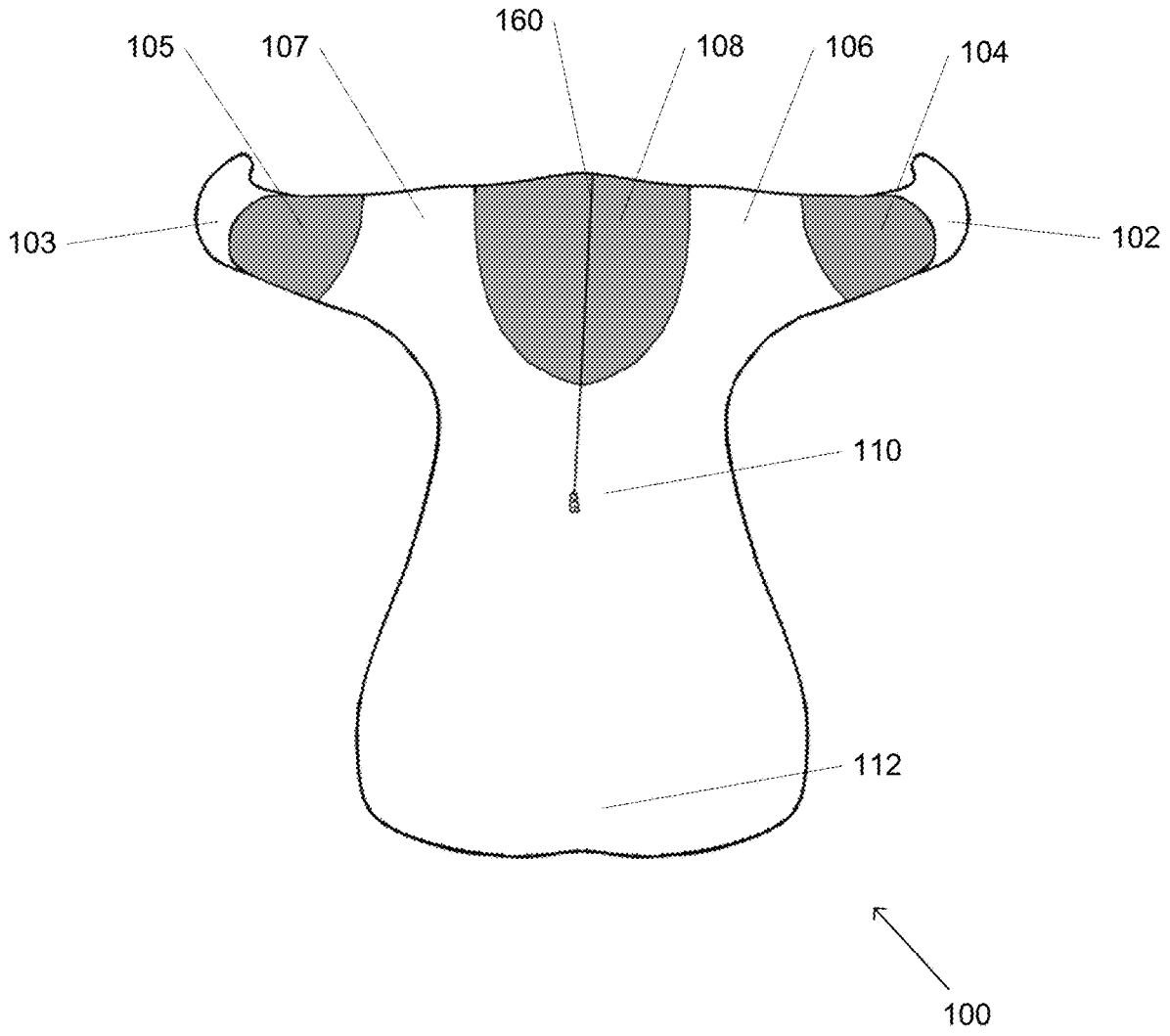
FIG. 1B illustrates a rear view of an article of infant clothing with detachable teething surfaces and an enclosed bottom in accordance with an embodiment of the invention.

A rear view of the article of infant clothing with a teething surface in accordance with an embodiment of the invention is shown in FIG. 1B. Referring to FIG. 1B, the rear view of the infant bodysuit 100 may include the teething surfaces 102, 103, the distal arm portions 104, 105, the proximal arm portions 106, 107, the neck portion 108, the chest portion 110, and the bottom portion 112, as described above. In some embodiments, the teething surfaces 102, 103 may be present on both sides of the bodysuit 100 as illustrated in FIGS. 1A-1B. In other embodiments, the teething surfaces 102, 103 may be present on only one side of the bodysuit 100. In some embodiments, the proximal arm portions 106, 107 may be present on both sides of the bodysuit 100 as illustrated in FIGS. 1A-1B. In other embodiments, the proximal arm portions 106, 107 may be present on only one side of the bodysuit 100. Further, in some embodiments, the neck portion 108 may be present on both sides of the bodysuit 100 as illustrated in FIGS. 1A-1B. In other embodiments, the neck portion 108 may be present on only one side of the bodysuit 100.

In reference to FIG. 1B, the rear view of the infant bodysuit 100 may include a fastening device 160 such as, but not limited to, a zipper. For example, in various embodiments, the zipper 160 may be attached only part way down the back side of the chest portion 110, but it may be extended to the bottom portion 112 or may only extend through the neck portion 108.

In further reference to FIGS. 1A-B, the teething surfaces 102, 103 may be made of rubber, silicone and/or plastic to provide teething surfaces that are soothing to an infant's tender gums. In various embodiments, the teething surfaces may be curved like a hook, and when attached may be angled toward a child's mouth. Although bodysuits having teething surfaces are discussed above with respect to FIGS. 1A-B, any of a variety of bodysuits including a variety of teething surfaces, distal arm portions, proximal arm portions, neck portions, chest portions, and/or bottom portions as appropriate to the requirements of a specific application can be utilized in accordance with embodiments of the invention. In addition, any and all surfaces and/or portions constructed using a water resistant material may also be constructed using an anti-bacterial material in addition to, or in place of, the water resistant material. Various teething surfaces in accordance with embodiments of the invention are discussed further below.

Various Teething Surfaces

Figure 2:
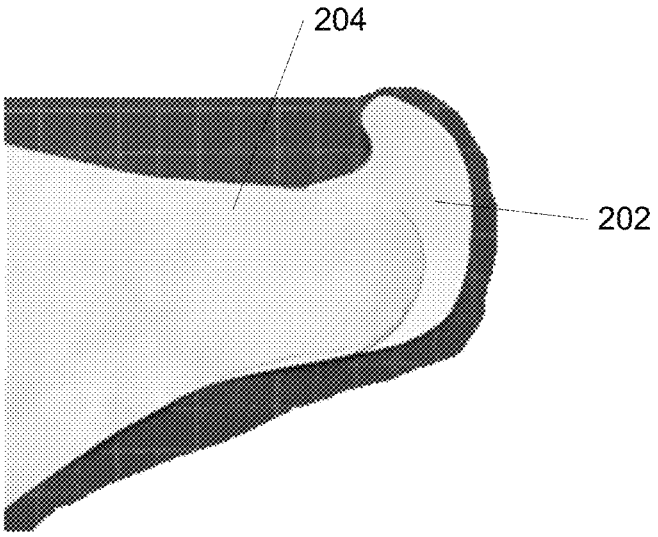
FIG. 2 is a close-up illustration of a distal end of an arm portion with a teething surface attached in accordance with an embodiment of the invention.

The various portions including, but not limited to, the teething surfaces may take on various shapes and sizes in accordance with embodiments of the invention. A close-up illustration of a distal end of an arm portion with a teething surface attached in accordance with an embodiment of the invention is illustrated in FIG. 2. The close-up illustration 200 shows a teething surface 202 attached to an arm portion 204. In many embodiments, the teething surface 202 may be flat and curved. For example, the teething surface 202 may take on a hook shape. In some embodiments, the teething surface 202 may also have a raised, uneven, ridge-like, and/or bumpy texture.

Figure 3A:
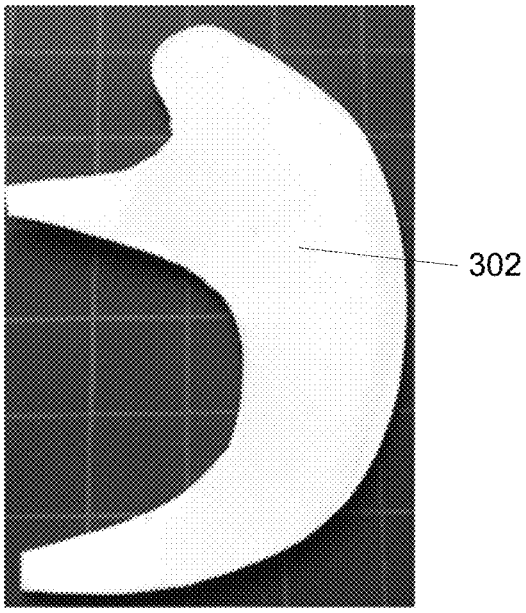
FIG. 3A is an outline of a teething surface detached from the article of infant clothing in accordance with an embodiment of the invention.

In addition, various teething surfaces may be detachable from an infant bodysuit. An outline of a teething surface detached from an article of infant clothing in accordance with an embodiment of the invention is shown in FIG. 3A. As illustrated, the outline 300 shows, a teething surface 302. In many embodiments, the teething surface 302 may be detachable from the infant bodysuit. For example, the teething surface 302 may detach from a distal arm portion of the infant bodysuit. In some embodiments, the teething surface 302 may be attached to the infant bodysuit, as further described below. In such embodiments, the teething surface 302 may be removed for cleaning and/or may be replaced with another teething surface, as further described below.

Figure 3B:
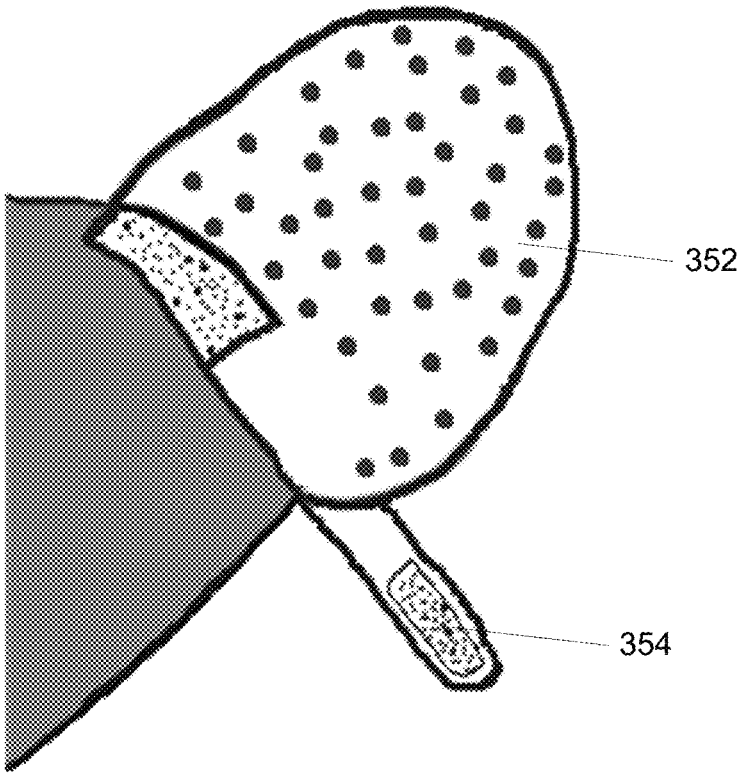
FIG. 3B is an illustration of a detachable mitten-shaped teething surface in accordance with an embodiment of the invention.

An illustration of a detachable mitten-shaped teething surface in accordance with an embodiment of the invention is shown in FIG. 3B. The illustration 350 shows, a mitten shaped teething surface 352 configured to cover an infant's hand. In some embodiments, the mitten 352 may entirely be made of a water resistant material, as described above. In other embodiments, the mitten 352 may be made of cloth and covered using a water resistant and/or anti-bacterial material, as described above. In some embodiments, one or more fasteners 354 may be used to secure the mitten 352 to an infant's hand. For example, the fastener 354 may include a loop, a hook, one or more Velcro portions, etc. In some embodiments, the mitten 352 may be secured to the infant bodysuit, as further described below. Although specific teething surfaces are discussed above with respect to FIGS. 2-3B, any of a variety of teething surfaces as appropriate to the requirements of a specific application can be utilized in accordance with embodiments of the invention. An infant bodysuit with detachable hand portions in accordance with embodiments of the invention are discussed further below.

Bodysuits with Detachable Hand Portions Having Teething Surfaces

Figure 4:
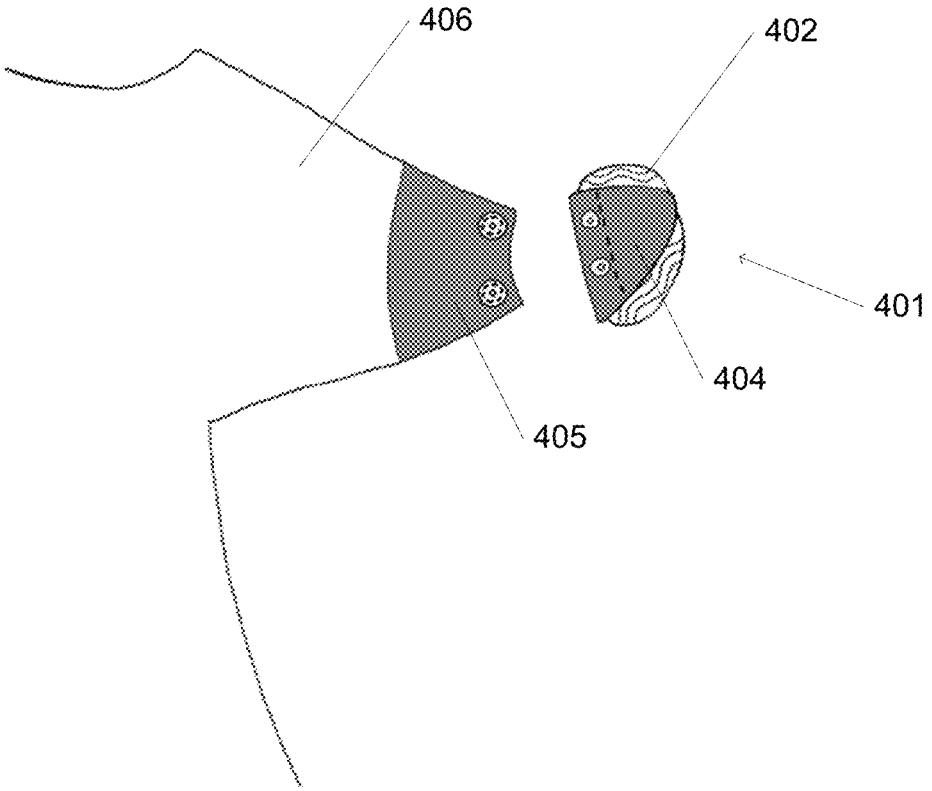
FIG. 4 is a close-up illustration of an arm portion with a detachable hand portion in accordance with an embodiment of the invention.

The present invention may include infant bodysuits with detachable hand portions having teething surfaces. A close-up illustration of an arm portion with a detachable hand portion in accordance with an embodiment of the invention is shown in FIG. 4. The illustration 400 illustrates a hand portion 401 having a teething surface 402. In many embodiments, the hand portion 401 may include a first portion 404 of a distal arm portion and a teething surface 402. In various embodiments, the hand portion 401 may be detachable from infant bodysuit at a second portion 405 of the distal arm portion of the infant bodysuit.

In reference to FIG. 4, the hand portion 401 may be detached from the infant bodysuit for drying an infant's hands, giving the infant freedom to use his or her hands, and/or to clean the hand portion 401 separately from the article of infant clothing. The hand portion 401 may be attached and/or detached from the second portion 405 of the distal arm portion using various mechanisms including, but not limited to, snap fasteners. The second portion 405 of the distal arm portion and a proximal arm portion 406 may form a non-detachable sleeve of the article of infant clothing. In many embodiments, the hand portion 401 may be detached using the same snap fasteners.

Although specific infant bodysuits with detachable hand portions are discussed above with respect to FIG. 4, any of a variety of articles of clothing having a variety of hand portions, teething surfaces, fasteners, etc. as appropriate to the requirements of a specific application can be utilized in accordance with embodiments of the invention. Infant bodysuits with leg portions in accordance with embodiments of the invention are discussed further below.

Bodysuit with Leg Portions

Figure 5:
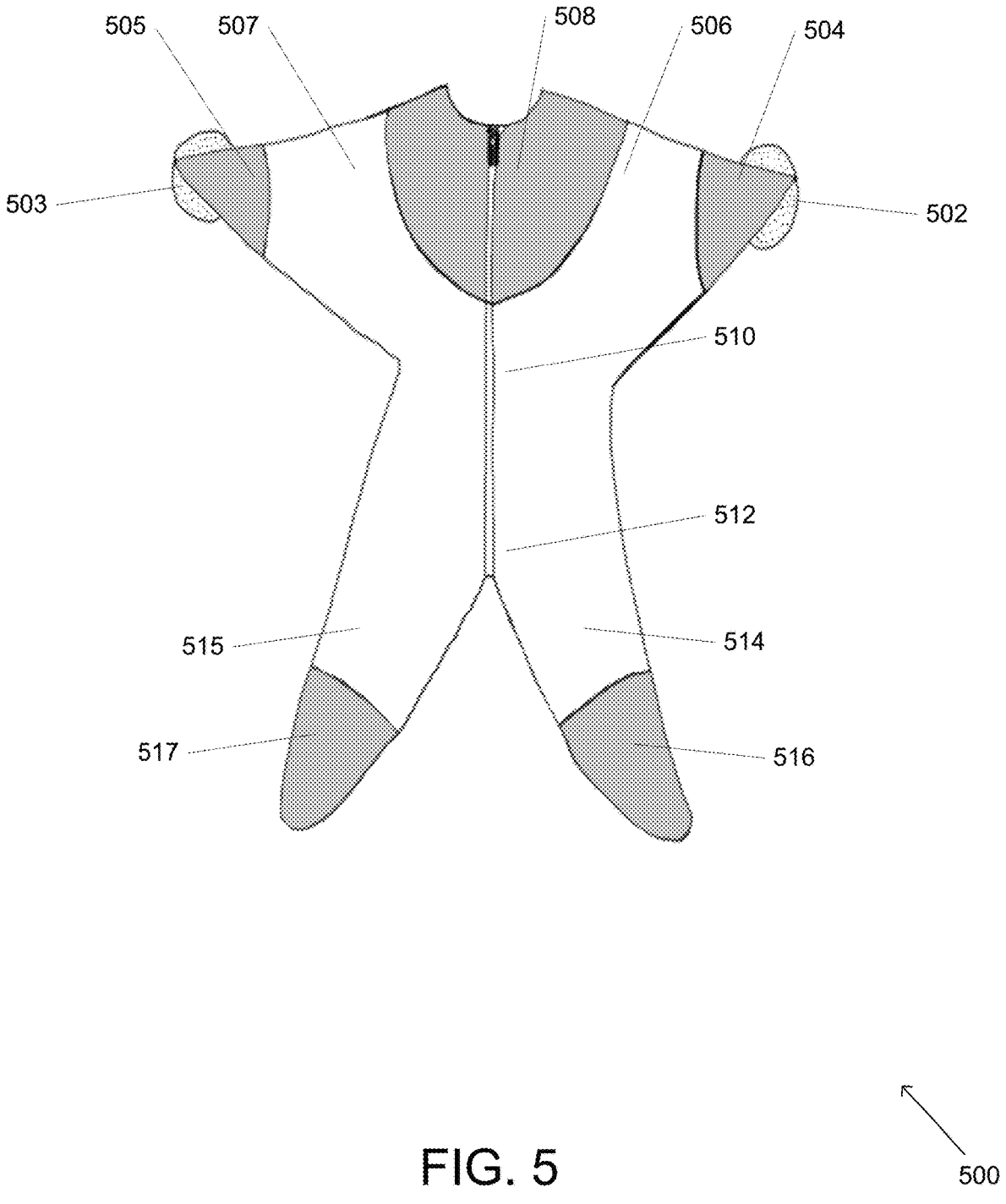
FIG. 5 is an embodiment of an article of infant clothing with leg portions in accordance with an embodiment of the invention.

Infant bodysuits in accordance with embodiments of the invention may include one or more leg portions. An embodiment of an article of infant clothing with leg portions in accordance with an embodiment of the invention is illustrated in FIG. 5. In many embodiments, an infant bodysuit 500 may include teething surfaces 502, 503, distal arm portions 504, 505, proximal arm portions 506, 507, a neck portion 508, a chest portion 510, and a bottom portion 512, as described above. In addition, in various embodiments, the infant bodysuit may also include proximal leg portions 514, 515 and distal leg portions 516, 517.

In reference to FIG. 5, the distal arm portion 504 and the proximal arm portion 506 together may form one sleeve of the infant bodysuit 500. The distal arm portion 505 and the proximal arm portion 507 together may form the other sleeve of the infant bodysuit 500. As described above, a neck portion 508 may be located between the two sleeves. In various embodiments, the bottom portion 512 may be connected to the proximal leg portions 514, 515. Further, the chest portion 510 may located between the neck portion 508 and the bottom portion 512. The distal leg portions 516, 517 may be with the enclosed bottom parts and they may cover an infant's legs and/or feet.

In further reference to FIG. 5, the distal arm portions 504, 505, the neck portion 508, and the distal leg portions 516, 517 may be covered with a water resistant and/or anti-bacterial material such as, but not limited to, polyvinyl chloride or polyurethane, to prevent saliva from penetrating the fabric, as described above. In some embodiments, the distal arm portions 504, 505, the neck portion 508, and the distal leg portions 516, 517 may be constructed using a water resistant and/or anti-bacterial material, as further described above.

In further reference to FIG. 5, the teething surface 502 may be attached to the end of the distal arm portion 504, and the teething surface 503 may be attached to the end of the distal arm portion 505. The teething surfaces 502, 503 may cover a portion of the distal arm portions 504, 505 which an infant's fingers may be located at. In various embodiments, the teething surfaces 502, 503 may be made of various materials such as, but not limited to, rubber, silicone and/or plastic to provide teething surfaces that are soothing to an infant's tender gums. Referring to FIG. 5, the teething surfaces 502, 503 may be various shapes and sizes, as further described above. For example, the teething surfaces 502, 503 may be round shape while also having an uneven, ridge-like, or bumpy texture. In addition, the teething surfaces 502, 503 may be interchangeable, so they can be detached from the distal arm portions 504, 505, respectively, of the infant bodysuit 500. In some embodiments, the infant bodysuit 500 may also include a fastening arrangement such as a zipper. For example, a zipper may be attached down to the bottom portion 512. In other embodiments, the zipper may be attached down to the chest portion 510.

Although specific infant bodysuits with leg portions are discussed above with respect to FIG. 5, any of a variety of infant bodysuits including leg portions as appropriate to the requirements of a specific application can be utilized in accordance with embodiments of the invention. For example, the material and design used on the teething surfaces may vary, depending on the type of pattern, surface coarseness, firmness or flexibility required. Additionally, the surface of the teething surface may have any variety or combination of textures, grooves, and shapes such as waves or dots. In addition, the attachment of the teething surfaces may be performed using various devices and methods, such as, but not limited to, using a strap, zip, snaps, poppers, hook and loop, buttons, etc. Further, a variety of fabrics and materials may be used in the construction of the article of infant clothing including but not limited to cotton, polyester, wool, or any blend thereof. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. An article of clothing for soothing a teething child comprising:

a first arm portion comprising:

a first teething surface wherein the first teething surface is affixed to a distal end of the first arm portion, and the first teething surface curves perpendicular to the length of the first arm portion; and a first water resistant surface attached to an outer surface of the distal end of the first arm portion, wherein the distal end of the first arm portion closes the first arm portion to enclose a hand of the child within the first arm portion; and a second arm portion comprising:

a second teething surface wherein the second teething surface is affixed to a distal end of the second arm portion, and the second teething surface curves perpendicular to the length of the second arm portion; and a second water resistant surface attached to an outer surface of the distal end of the second arm portion, wherein the distal end of the second arm portion closes the second arm portion to enclose a hand of the child within the second arm portion.

2. The article of clothing of claim 1 further comprising a neck portion comprising a front inner surface, a front outer surface, a rear inner surface, and a rear outer surface.

3. The article of clothing of claim 2 further comprising a third water resistant surface attached to the front outer surface of the neck portion.

4. The article of clothing of claim 3 further comprising a chest portion and a bottom portion.

5. The article of clothing of claim 4 wherein the bottom portion further comprising a first leg portion.

6. The article of clothing of claim 5 wherein the first leg portion further comprises a fourth water resistant surface attached to an outer surface of a distal end of the first leg portion.

7. The article of clothing of claim 6 wherein the bottom portion further comprises a second leg portion.

8. The article of clothing of claim 7 wherein the second leg portion further comprises a fifth water resistant surface attached to an outer surface of a distal end of the second leg portion.

9. The article of clothing of claim 8, wherein the first, second, third, fourth, and fifth water resistant surfaces are made of polyvinyl chloride.

10. The article of clothing of claim 8, wherein the first, second, third, fourth, and fifth water resistant surfaces are made of polyurethane.

11. The article of clothing of claim 8, wherein the first, second, third, fourth, and fifth water resistant surfaces are made of fluoropolymers.

12. The article of clothing of claim 8, wherein the first and second teething surfaces are made of silicone.

13. The article of clothing of claim 8, wherein the first and second teething surfaces are made of rubber.

14. The article of clothing of claim 8, wherein the first and second teething surfaces are detachable from the first arm portion and second arm portion, respectively.

15. The article of clothing of claim 1, wherein the first arm portion and second arm portion are detachable from the article of clothing.

16. The article of clothing of claim 1, wherein a hand portion of the first arm portion and a hand portion of the second arm portion are detachable from the article of clothing.

17. The article of clothing of claim 1 further comprises a fastening arrangement.

18. The article of clothing of claim 17, wherein the fastening arrangement is at least one of a zipper, a button, a snap, and a hook.

* * * * *